US006513892B2

(12) United States Patent
Inoue et al.

(10) Patent No.: US 6,513,892 B2
(45) Date of Patent: Feb. 4, 2003

(54) PRINTER WITH AN INK CONTAINER AND AN INK REMAINDER DETECTOR

(75) Inventors: Hideaki Inoue, Amimachi (JP); Makoto Miyaki, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 42 days.

(21) Appl. No.: 09/861,767

(22) Filed: May 22, 2001

(65) Prior Publication Data

US 2001/0042468 A1 Nov. 22, 2001

(30) Foreign Application Priority Data

May 22, 2000 (JP) ..... 2000-150449

(51) Int. Cl.[7] ..... B41J 2/195; G01F 23/292
(52) U.S. Cl. ..... 347/7; 73/293; 417/63
(58) Field of Search ..... 347/7, 19, 85, 347/86; 73/290 R, 293; 417/63; G01F 23/292; B41J 2/195

(56) References Cited

U.S. PATENT DOCUMENTS 1,532,995 A * 4/1925 Gage ..... 73/293
4,566,547 A * 1/1986 Furukawa ..... 177/46
5,652,610 A * 7/1997 Kawai et al. ..... 347/87

FOREIGN PATENT DOCUMENTS

DE 197 02 283 8/1998
EP 0 443 245 8/1991
JP 06-199371 7/1994
JP 07-061739 3/1995

OTHER PUBLICATIONS

Patent Abstracts of Japan, 08–281966 Oct. 29, 1996.
Patent Abstracts of Japan, 63–115757 May 20, 1988.
Patent Abstracts of Japan, 63–147650 Jun. 20, 1988.
Search Report, Mailing Date: Aug. 11, 2001.

* cited by examiner

*Primary Examiner*—John Barlow
*Assistant Examiner*—Blaise Mouttet
(74) *Attorney, Agent, or Firm*—Nixon Peabody LLP; Donald R. Studebaker

(57) ABSTRACT

A printer includes a printing mechanism and an ink container. The ink container includes a cylinder having a side wall and provided with an ink discharge port in its front end face, a piston received in the cylinder to be slidable along the side wall of the cylinder, and ink between the piston and the front end face in the cylinder. An LED projects light onto the side wall of the cylinder in a predetermined position in the longitudinal direction of the cylinder, and a phototransistor is positioned near a rear end face of the cylinder to be adapted to receive the light projected by the LED and passing through the side wall of the cylinder only once, and outputs an electric signal upon receipt of light. The remainder of ink in the ink container is detected on the basis of the output of the phototransistor.

10 Claims, 5 Drawing Sheets

PRINTER WITH AN INK CONTAINER AND AN INK REMAINDER DETECTOR

BACKGROUND OF THE INVENTION

1. Field of the Invention

This invention relates to a printer, and more particularly to a printer provided with an ink remainder detecting means.

2. Description of the Related Art

In a printer, an ink container is generally mounted to be removable from the printer body, and when the ink in the ink container is consumed, the ink container is replaced with a new refill (a disposable type) or the ink container is removed from the printer body, refilled with ink and then returned to the printer body (a reusable type).

Which ever type is employed, it is necessary to watch the remainder of ink in the ink container, or the ink can suddenly run out to force the printer to be stopped until the ink container is replaced with anew refill or the ink container is refilled with ink. That the time efficiency is high is a strong point of a printer such as a stencil printer. However when the ink suddenly runs out to force the printer to be stopped until the ink container is replaced with a new refill or the ink container is refilled with ink, such a strong point of the printer is hurt. Accordingly, it is necessary that the ink is about to be exhausted is recognized at least immediately before the ink actually runs out.

This problem can be overcome in the simplest way by the user visually watching the remainder of ink. However since the ink container is generally placed deep in the printer, the user must check the remainder of ink by taking out the ink container and opening the cap with the printer stopped. If the ink container is of transparent or semitransparent material, the user can check the remainder of ink with the cap kept on. However these actions are troublesome to the user. Accordingly, systems for detecting that the remainder of ink in the ink container becomes small have been proposed or have been put into practice.

For example, in a first system disclosed, for instance, in Japanese Unexamined Patent Publication No. 7 (1995)-61739, ink is sucked out from the ink container and supplied to the printing drum by an ink pump, and when no ink is sucked out from the ink container in response to operation of the ink pump, it is determined that there hardly remains ink in the ink container.

In a second system disclosed, for instance, in Japanese Unexamined Patent Publication No. 6(1994)-199371, a light emitting/receiving optics is provided on the ink container to emit light toward an inner cap for scraping down ink and to receive reflected light from the inner cap, and the remainder of ink in the ink container is determined on the basis of the amount of reflected light which represents the position of the inner cap.

Third, there has been proposed a system in which a plurality of light emitters are positioned on one side of a semitransparent ink container at different levels with a plurality of light receivers positioned on opposite side of the ink container to be opposed to the respective light emitters so that when ink exists between a combination of the light emitter and the light receiver, light emitted from the light emitted cannot be received by the light receiver. The remainder of ink in the ink container can be detected on the basis of which light receiver receives light and which light receiver does not receive light. In this system, the remainder of ink can be detected in a plurality of stages, e.g., the ink container is full, the remainder of ink is not smaller than a predetermined amount, or the remainder of ink is smaller than the predetermined amount.

The first system is disadvantageous in that though it can detect whether or not ink remains in the ink container, it cannot detect the amount of the remainder of ink in the ink container, and accordingly, the user cannot obtain information on the remainder of ink until the ink runs out, which does not permit the user to prepare in advance against ink running out.

Further, though the second system can theoretically detect the remainder of ink continuously, actually it is very difficult to accurately detect the remainder of ink. That is, the light projected onto the inner cap is reflected not only by the inner cap but also by various surfaces such as inner wall surfaces of the ink container, and the inner cap is not strictly held horizontal. Accordingly, noise is often generated in the reflected light, which deteriorates accuracy in detecting the remainder of ink.

Further, when light emitters are positioned on one side of a semitransparent ink container and light receivers positioned are disposed on opposite side of the ink container to be opposed to the respective light emitters, the light receivers receive light after it travels through the wall of the ink container twice, which results in that the light receivers can receive only a very small amount of light and accuracy in detecting the remainder of ink is deteriorated.

SUMMARY OF THE INVENTION

In view of the foregoing observations and description, the primary object of the present invention is to provide a printer in which the remainder of ink can be more accurately detected before ink actually runs out with a simple method and structure.

In accordance with the present invention, there is provided a printer comprising a printing mechanism which prints on printing media with ink, and an ink container which supplies ink to the printing mechanism and comprises a cylinder having a side wall formed of transparent or semitransparent material and provided with an ink discharge port in a front end face thereof, a piston received in the cylinder to be slidable along the sidewall of the cylinder in the longitudinal direction thereof, and ink between the piston and the front end face in the cylinder, wherein the improvement comprises

- a light projecting means which projects light onto the side wall of the cylinder in a predetermined position in the longitudinal direction of the cylinder,
- a photodetector which is positioned near a rear end face of the cylinder to be adapted to receive the light projected by the light projecting means and passing through the side wall of the cylinder only once, and outputs an electric signal upon receipt of light, and
- an ink remainder detecting means which detects the remainder of ink in the ink container on the basis of the electric signal output from the photodetector.

The "transparent or semitransparent" material of the side wall of the cylinder is a material permeable to the light projected by the light projecting means to such an extent that the photodetector can detect the light emitted from the light projecting means through the side wall of the cylinder.

The ink container may be of a type which is fixed to the printer body and is refilled with ink when the ink is consumed, or a type which is removably mounted to the printer body and is replaced by a new refill (i.e., a new ink container filled with ink) when the ink is consumed, or a type which is removably mounted to the printer body, removed from the printer body, refilled with ink and then returned to the printer body when the ink is consumed.

It is preferred that the light projecting means comprises a plurality of light emitting elements which are provided to project light beams onto the side wall of the cylinder in a plurality of different positions as viewed in the longitudinal direction of the cylinder and are turned on in different manners by position, and the ink remainder detecting means detects the remainder of ink in the ink container on the basis of change in the electric signal output from the photodetector.

For example, the light emitting elements may be momentarily turned on in sequence by position, or the light emitting elements may be turned on at different timings by position or the light emitting elements may be turned off at different timings by position.

Also, it is possible that the light projecting means comprises a plurality of light emitting elements which are provided to project light beams onto the side wall of the cylinder in a plurality of different positions as viewed in the longitudinal direction of the cylinder and are simultaneously turned on, and the ink remainder detecting means detects the remainder of ink in the ink container on the basis of the level of the electric signal output from the photodetector.

It is preferred that a plurality of light emitting elements be provided to project light beams onto the side wall of the cylinder in different circumferential positions in each longitudinal position.

Since ink is generally impermeable to light, when the light projecting means projects light onto the side wall of the cylinder in a position where ink still exists, no or very little light is received by the photodetector, and accordingly the output of the photodetector is 0 or substantially 0. Whereas, when the light projecting means projects light onto the side wall of the cylinder in a position where ink does not exist, a major part of the light projected by the light projecting means is received by the photodetector, and accordingly the output of the photodetector is at a high level.

In one very simple embodiment of the present invention, a single light emitting element is provided to project a light beam onto the side wall of the cylinder in a single longitudinal position.

In this case, if ink still exists in the longitudinal position of the cylinder in which the light beam is projected, light emitted by the light emitting element hardly reaches the photodetector whereas if no ink remains in the longitudinal position of the cylinder in which the light beam is projected, light emitted by almost all the light emitting element reaches the photodetector. Accordingly, it may be determined whether the ink remains up to the position on the basis of the output of the photodetector.

Further, it is possible to provide a plurality of light emitting elements to project light beams onto the side wall of the cylinder in a plurality of different longitudinal positions. In this case, the remainder of ink in the ink container can be detected in a plurality of stages when the photodetector is effective enough to detect the difference in the amount of light which changes with the number of light emitting elements the light from which is cut by ink. Even if the photodetector is not so sensitive, the remainder of ink in the ink container can be detected in a plurality of stages by turning on the light emitting elements in different manners by position.

For example, by turning on the light emitting elements are momentarily turned on in sequence by position while watching whether the photodetector receives light, the light from which is cut by ink can be detected, whereby the remainder of ink in the ink container can be detected in a plurality of stages.

Further, so long as the photodetector can sense change in the amount of light when one of the light emitting elements are turned on in addition or when one of the light emitting elements which have been on is turned off, the remainder of ink in the ink container can be detected in a plurality of stages by turning on or off the plurality of light emitting elements at different timings.

Depending on the kind of the light emitting elements, e.g., in the case of the LED, light can be emitted in higher intensity when the elements are turned on in a pulse-like fashion than when the elements are continuously operated, which contributes to increase in detecting accuracy.

When a plurality of light emitting elements are provided to project light beams onto the side wall of the cylinder in different circumferential positions in each longitudinal position, the remainder of ink can be accurately detected even if the inner surface of the cylinder is stained by ink, or the ink is consumed in different amounts in a circumferential direction of the cylinder. In this case, it is preferred that a larger number light emitting elements be provided for a longitudinal position existence of ink in which is to be more accurately detected, e.g., the position corresponding to zero remainder.

The present invention can be applied to existing printers as they are so long as the side wall of the cylinder of the ink container is permeable to light.

When the ink remainder is thus detected, for instance, deterioration in time efficiency due to ink suddenly running out during printing can be prevented.

Further, since light emitted from the light projecting means passes through the side wall of the cylinder only once before received by the photodetector, the light is not weakened, whereby the remainder of the ink in the ink container can be more surely detected.

DESCRIPTION OF THE PREFERRED EMBODIMENT

Figure 1:
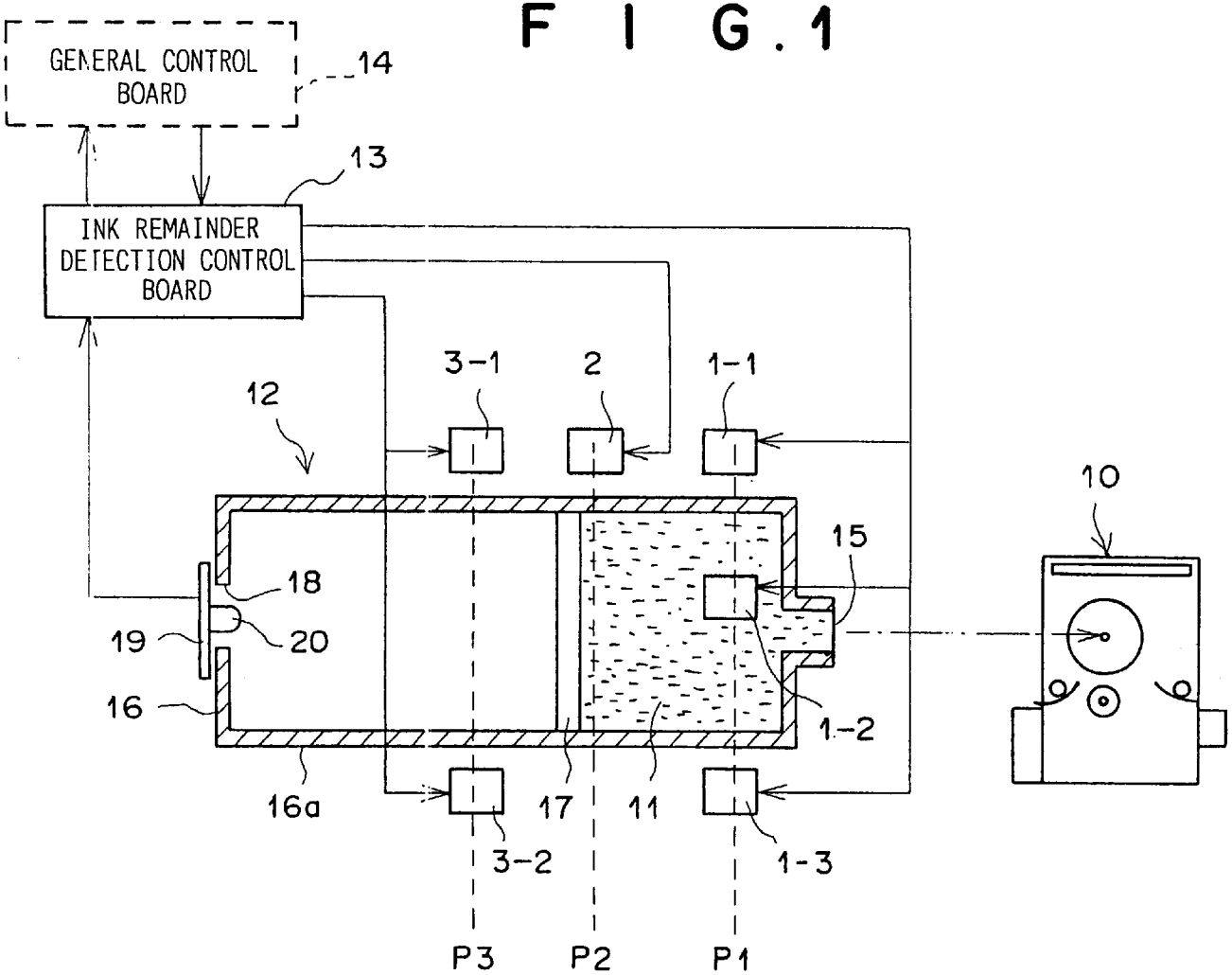
FIG. 1 is a schematic view showing a printer in accordance with an embodiment of the present invention.

FIG. 1 shows a stencil printer in accordance with an embodiment of the present invention. The stencil, printer comprises a printing mechanism 10 which prints on printing media (not shown) such as printing paper, transparent sheets for an OHP and the like and of a known structure including a printing drum, a sheet conveyance mechanism and the like; an ink container 12 containing therein printing ink 11; an ink remainder detection control board 13 which concerns with detection of the remainder of the ink 11; and a general control board 14 for controlling the overall stencil printer.

Since the printing mechanism 10 is of a known structure as described above, the printing mechanism 10 will not be described here.

The ink container 12 comprises a cylinder 16 which is substantially cylindrical in shape and has an ink discharge port 15 in the front end face thereof, and a piston 17 which is slidable back and forth along the inner side surface 16*a* of the cylinder 16 toward and away from the ink discharge port 15. The ink 11 is contained in the space in the cylinder 16 between the front end face and the piston 17.

The cylinder 16 and the piston 17 are formed of a material such as polyethylene or polyester which is not chemically attacked by the components or the solvent of the ink 11, and is semitranslucent. The piston 17 is moved toward the ink discharge port 15 under the atmospheric pressure as the ink 11 is discharged through the ink discharge port 15 by a sucking means such as a pump(not shown) and the remainder of the ink 11 in the ink container becomes smaller. An opening 18 is formed in the rear end face of the cylinder 16 and a photodetector 20 is held in the opening 18 by a circuit board 19.

The shape, structure and the like of the ink container 12 and the components and the like of the ink 11 may be the same as those which have been generally employed. That is, the present invention can be applied to the existing ink containers.

The ink container 12 may be of a type which is fixed to the printer body and is refilled with ink when the ink is consumed, or a type which is removably mounted to the printer body and is replaced by a new refill (i.e., a new ink container filled with ink), or a type which is removably mounted to the printer body, removed from the printer body, refilled with ink and then returned to the printer body.

In three positions P1, P2 and P3 arranged in the longitudinal direction thereof (the direction in which the piston 17 is slid) along the cylinder 16, first to third LEDs 1 to 3 are disposed. The position P1 is a position where the piston 17 is positioned when the remainder of the ink 11 in the ink container 12 is 10%, and in this particular embodiment, three first LEDs 1 (1-1, 1-2, 1-3) are disposed in the position P1 at regular intervals (at 120°) in the circumferential direction of the cylinder 16. The position P2 is a position where the piston 17 is positioned when the remainder of the ink 11 in the ink container 12 is 30%, and in this particular embodiment, only one second LED 2 is disposed in the position P2. The position P3 is a position where the piston 17 is positioned when the remainder of the ink 11 in the ink container 12 is 50%, and in this particular embodiment, two third LEDs 3 (3-1, 3-2) are disposed in the position P3 at regular intervals (at 180°) in the circumferential direction of the cylinder 16.

Light emitted from each of the LEDs 1, 2 and 3 is received by the photodetector 20 after once passing through the side wall of the cylinder 16 so long as no ink exists in the part of the ink container 12 opposed to the LED. Whereas when there remains ink 11 in the part of the ink container 12 opposed to the LED, light emitted from the LED is cut by the ink 11 and cannot be received by the photodetector 20. At this time, output of the photodetector 20 is 0 or very small.

The inner side surface 16a of the cylinder 16 is sometimes stained by the ink 11, which can cut the light emitted from the LED even there remains no ink 11 in part of the ink container 12 opposed to the LED. However, in the positions P1 and P3, since there are disposed a plurality of LEDS, the light emitted from all the LEDs will not be cut by the stain of ink.

Figure 2:
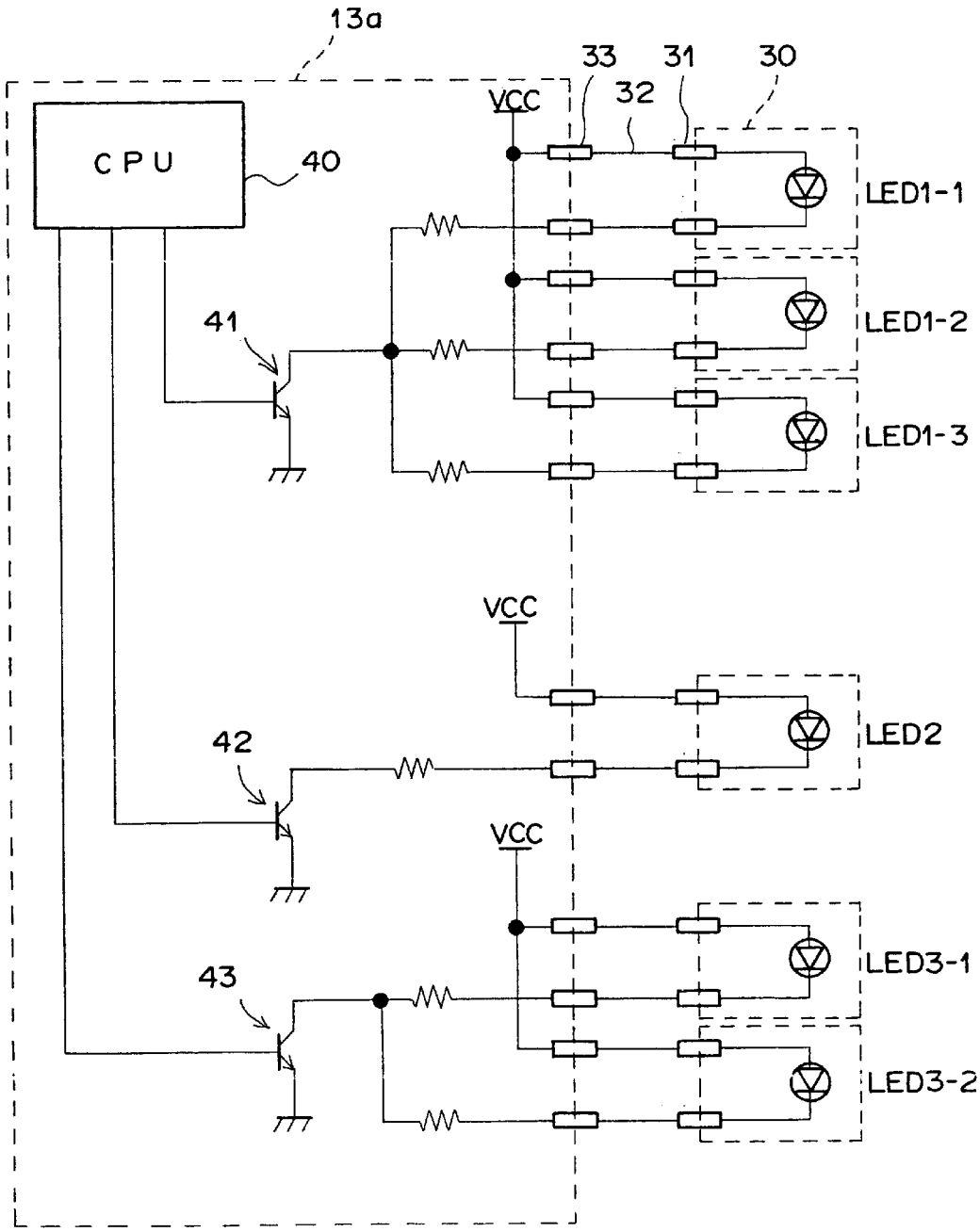
FIG. 2 is a circuit diagram showing the LED drive circuit of the printer shown in FIG. 1.

FIG. 2 shows an LED drive circuit driving the LEDs 1 to 3. As shown in FIG. 2, each of the LEDs 1-1, 1-2, 1-3, 2, 3-1 and 3-2 is supported in its position by a circuit board 30, and is connected to an LED drive portion 13*a* of the ink remainder detection control board 13 (FIG. 1) through a connector 31, a lead cable 32 and a connector 33.

The three first LEDs 1-1, 1-2 and 1-3 in the position P1 are connected to a CPU 40 by way of a drive transistor 41 in parallel to each other. When a drive signal (a high level signal) is input from the CPU 40 into the base of the drive transistor 41, the three first LEDs 1-1, 1-2 and 1-3 in the position P1 are turned on simultaneously.

The second LED 2 in the position P2 is connected to the CPU 40 by way of a drive transistor 42, and is turned on when a drive signal (a high level signal) is input from the CPU 40 into the base of the drive transistor 42.

The two third LEDs 3-1 and 3-2 in the position P3 are connected to the CPU 40 by way of a drive transistor 43 in parallel to each other. When a drive signal (a high level signal) is input from the CPU 40 into the base of the drive transistor 42, the two third LEDs 3-1 and 3-2 in the position P3 are turned on simultaneously.

Figure 3:
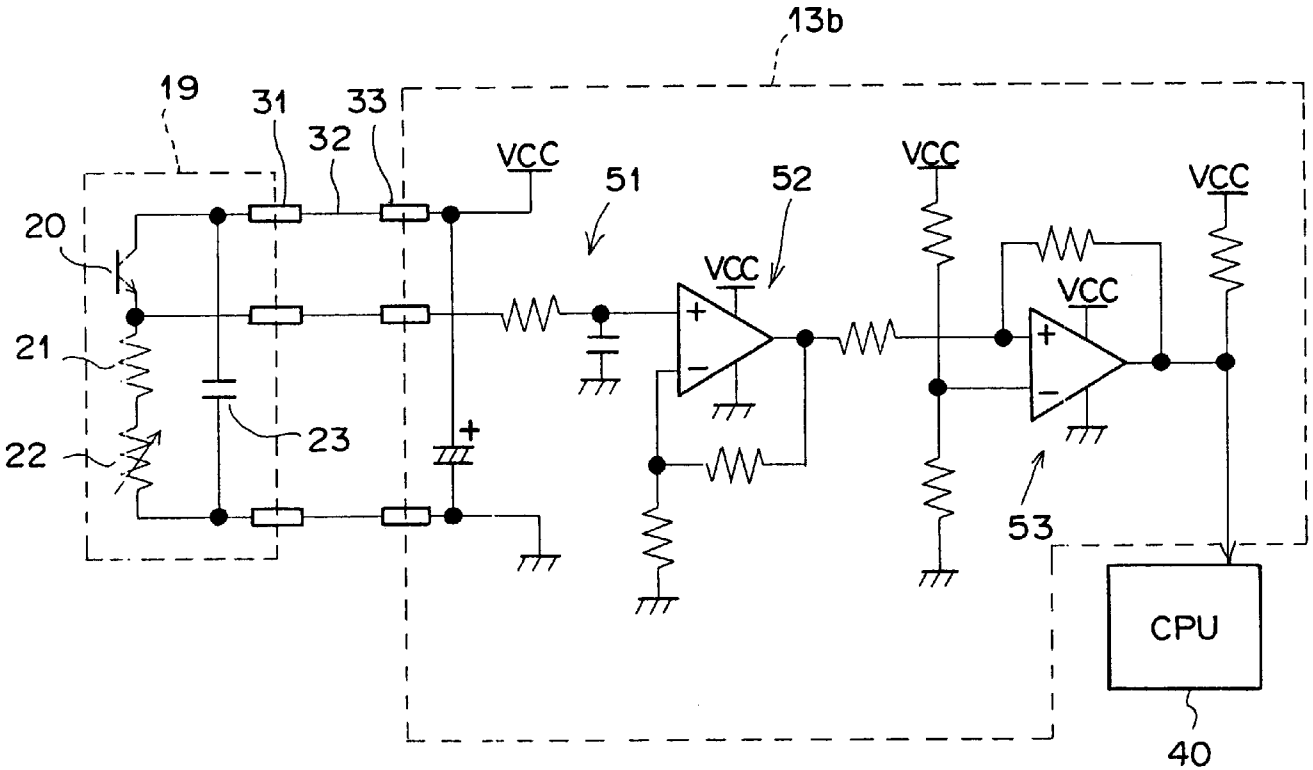
FIG. 3 is a circuit diagram showing the electric circuit for processing the output signal of the photodetector 20.

As the photodetector 20, a photoelectric converter element such as a phototransistor or a photodiode which outputs an electric signal upon receipt to light may be employed. In this particular embodiment, a phototransistor is employed. FIG. 3 shows an electric circuit for processing the output signal of the phototransistor 20. As shown in FIG. 3, the phototransistor 20 is mounted on the circuit board 19 together with a fixed resistor 21 and a variable resistor 22 for gain adjustment and a capacitor 23 for preventing oscillation. The elements on the circuit board 19 are connected to a light receiving portion 13b of the ink remainder detection control board 13 by way of connectors 31, lead cables 32 and connectors 33.

In this light receiving portion 13*b*, the emitter output of the phototransistor 20 is input into a comparator 53 by way of a low-pass filter 51 (an RC circuit) and an operational amplifier 52, and the output of the comparator 53 is input into the CPU 40. That is, when the phototransistor 20 receives light, the comparator 53 inputs a high level signal into the CPU 40, while the phototransistor 20 is not receiving light, the comparator 53 inputs a low level signal into the CPU 40.

The CPU 40, the low-pass filter 51, the operational amplifier 52 and the comparator 53 form an ink remainder detecting means. In the case where the CPU 40 is provided with an A/D converter input terminal, the analog output of the phototransistor 20 may be directly input into the CPU 40.

Figure 4:
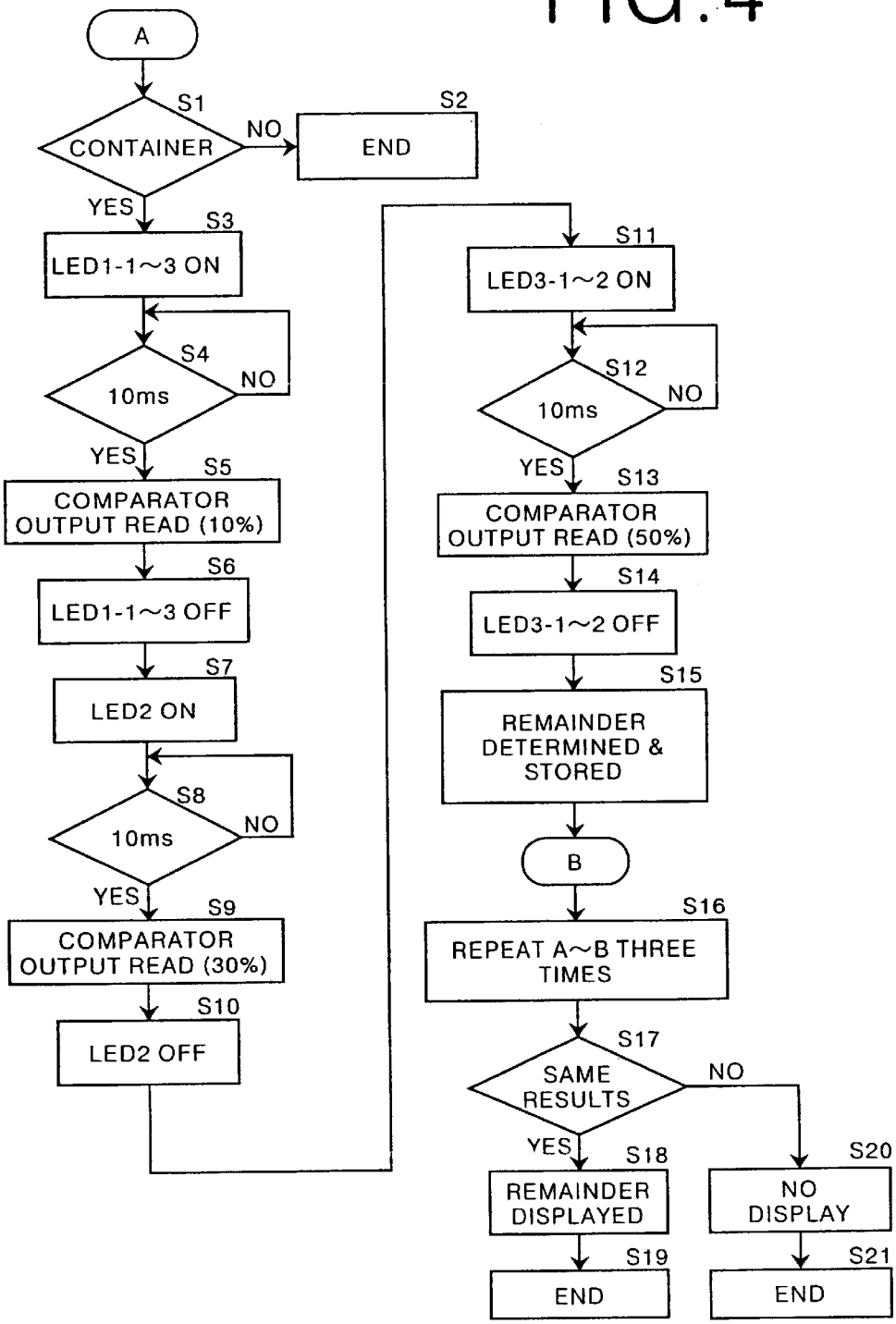
FIG. 4 is a flow chart for illustrating processing for detecting the remainder of ink.
Figure 5:
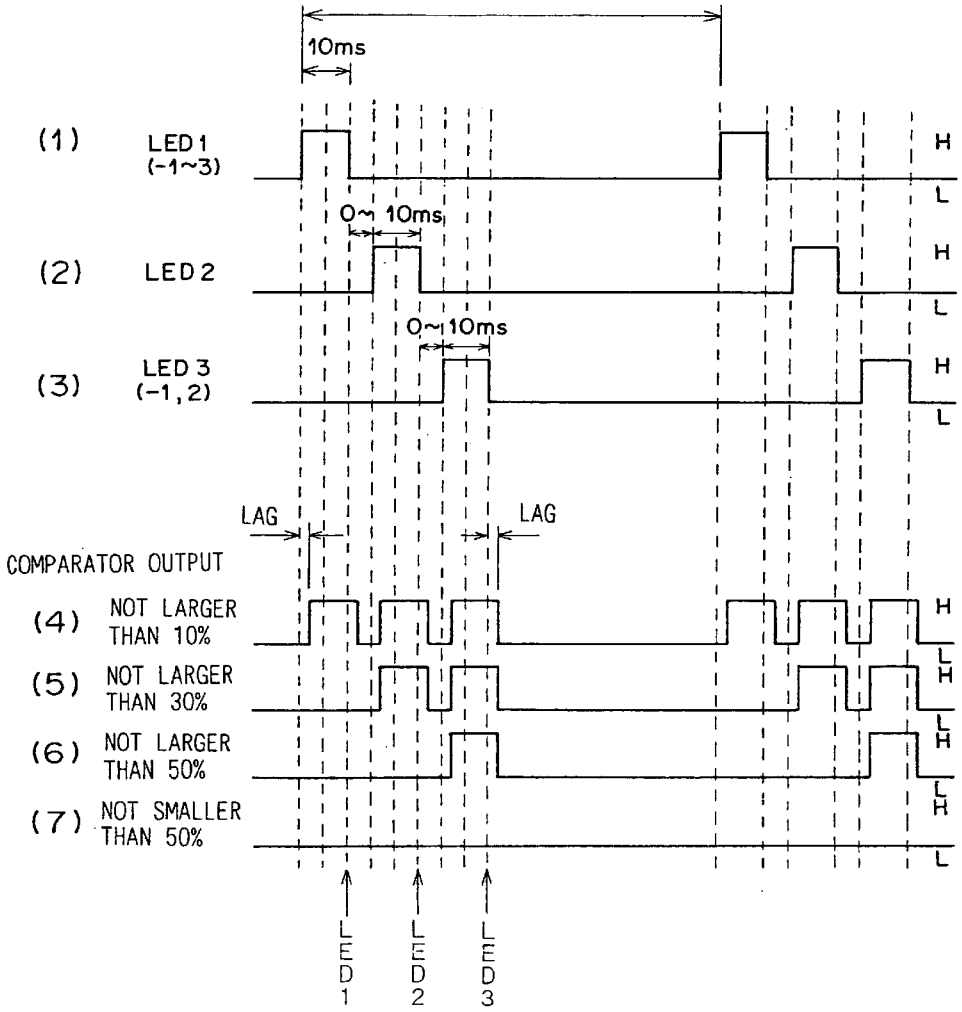
FIG. 5 shows drive waveforms for the first to third LEDs and the output waveform of the comparator in the printer shown in FIG. 1.

FIG. 4 is a flow chart for illustrating processing for detecting the remainder of ink, and FIG. 5 shows drive waveforms for the first to third LEDs 1, 2 and 3 and the output waveform of the comparator 53 when detecting the remainder of the ink 11 in the ink container 12.

The CPU 40 first determines whether an ink container 12 is set in place. (step S1) This can be detected, for instance, on the basis of the output of a photoelectric sensor or of a contactless switch. When it is determined that no ink container is in place, the CPU 40 immediately ends the processing. (step S2)

Otherwise, the CPU 40 turns on all the first LEDs 1 (1-1, 1-2, 1-3). (step S3) The drive waveform for turning on the first LEDs 1 is as shown in FIG. 5, line (1). Then 10 ms after turning on the first LEDs 1 (step S4), the CPU 40 reads the output of the comparator 53 (first reading). (step S5)

Thereafter, the CPU 40 turns off the first LEDs 1 in step S6 and turns on the second LED 2 in step S7. The drive waveform for turning on the second LED 2 is as shown in FIG. 5, line (2). Then 10 ms after turning on the second LED 2 (step S8) the CPU 40 reads the output of the comparator 53 (second reading). (step S9)

Thereafter, the CPU 40 turns off the second LED 2 in step S10 and turns on the third LEDs 3 in step S11. The drive waveform for turning on the third LEDs 3 is as shown in FIG. 5, line (3). 10 ms after turning on the second LED 2 (step S12), the CPU 40 reads the output of the comparator 53 (third reading). (step S13) Then the CPU 40 turns off the third LEDs 3. (step S14)

Subsequently, the CPU 40 determines the remainder of the ink 11 on the basis of the results of the first to third readings of the comparator output (steps S5, S9 and S13). (step S15) That is, when the output of the comparator 53 is high each of the first to third reading, i.e., when the phototransistor 20 receives light from all the first to third LEDs, the CPU 40 determines that the remainder of the ink 11 is not larger than 10%.

When the output of the comparator 53 is high in the second and third readings with the output of the comparator 53 being low in the first reading, i.e., when the phototransistor 20 receives light only from the second and third LEDs, the CPU 40 determines that the remainder of the ink 11 is not smaller 10% and not larger than 30%.

When the output of the comparator 53 is high only in the third reading, i.e., when the phototransistor 20 receives light only from the third LEDs 3, the CPU 40 determines that the remainder of the ink 11 is not smaller 30% and not larger than 50%.

When the output of the comparator 53 is low in all the first to third readings, i.e., when the phototransistor 20 receives light from none of the first to third LEDs, the CPU 40 determines that the remainder of the ink 11 is larger than 50%.

The remainder of the ink 11 thus determined is temporarily stored in a memory (not shown).

The CPU 40 repeats the processing from A to B (steps S1 to S15) three times and the values of the remainder of the ink 11 determined for the respective times are stored at different places in the memory. (step S16) Then the CPU 40 determines whether there are at least two same values in the three values of the remainder of the ink 11 determined three times. (step S17) When it is determined that there are at least two same values, the CPU 40 determines the same values as the real value of the remainder of the ink 11 and displays the value on a display (not shown). (step S18) Then the CPU 40 ends the processing. (step S19) Otherwise, the CPU 40 determines that defective detection occurs and ends the processing without displaying the value of the remainder of the ink 11. (steps S20 and 21).

As can be understood from the description above, light emitted from the LEDs 1, 2 and 3 passes through the side wall of the cylinder 16 only once before received by the phototransistor 20 and accordingly, is not weakened, whereby the remainder of the ink 11 in the ink container 12 can be more surely detected.

Further, in this embodiment, the first to third LEDs which are disposed in different positions in the direction of movement of the piston 17 are turned on in a pulse-like fashion at different timings and the remainder of the ink 11 is detected on the basis of change in the output of the phototransistor 20 which is two-valued, that is, whether or not the phototransistor 20 receives light. Accordingly, the remainder of the ink 11 can be detected at a high accuracy. When the LEDs are turned on in a pulse-like fashion, light can be emitted in higher intensity than when the LEDs are continuously operated, which contributes to increase in detecting accuracy.

When the ink remainder can be detected in this manner, it can be judged on the basis of the remainder of ink whether the ink container 12 is to be replaced by a new refill or whether the ink container 12 is to be replenished with ink. For example, when it has been known that a number of copies are to be printed in the next printing, it can be judged that one or more refills should be prepared even though more than 50% of ink remains in the ink container 12.

The number of the light emitting elements in each position need not be limited to three, one or two but may be as desired.

In the present invention, the color of ink, the wavelength of the emitted from the light projecting means, and the like need not be limited to a particular range. Further, it is possible to improve accuracy in detecting the ink remainder by increasing light collecting efficiency, for instance, by disposing a light condenser means such as a condenser lens in front of the photodetector or by using a photodetector having a larger light receiving face.

What is claimed is:

1. A printer comprising a printing mechanism which prints on printing media with ink, and an ink container which supplies ink to the printing mechanism and comprises a cylinder having a side wall formed of transparent or semitransparent material and provided with an ink discharge port in a front end face thereof, a piston received in the cylinder to be slidable along the side wall of the cylinder in the longitudinal direction thereof, and ink between the piston and the front end face in the cylinder, wherein the improvement comprises a light projecting means which projects light onto the side wall of the cylinder in a predetermined position in the longitudinal direction of the cylinder, a photodetector which is positioned near a rear end face of the cylinder to be adapted to receive the light projected by the light projecting means and passing through the side wall of the cylinder only once, and outputs an electric signal upon receipt of light, and an ink remainder detecting means which detects the remainder of ink in the ink container on the basis of the electric signal output from the photodetector.

2. A printer as defined in claim 1 in which the ink container is of a type which is fixed to the printer body and is refilled with ink when the ink is consumed.

3. A printer as defined in claim 1 in which the ink container is of a type which is removably mounted to the printer body and is replaced by a new refill when the ink is consumed.

4. A printer as defined in claim 1 in which the ink container is of a type which is removably mounted to the printer body, removed from the printer body, refilled with ink and then returned to the printer body when the ink is consumed.

5. A printer as defined in claim 1 in which the light projecting means comprises a plurality of light emitting elements which are provided to project light beams onto the side wall of the cylinder in a plurality of different positions as viewed in the longitudinal direction of the cylinder and are turned o n in different manners by position, and the ink remainder detecting means detects the remainder of ink in the ink container on the basis of change in the electric signal output from the photodetector.

6. A printer as defined in claim 5 in which the light emitting elements are momentarily turned on in sequence at different timing by position.

7. A printer as defined in claim 5 in which the light emitting elements are turned on at different timings by position.

8. A printer as defined in claim 5 in which the light emitting elements are turned off at different timings by position.

9. A printer as defined in claim 1 in which the light projecting means comprises a plurality of light emitting elements which are provided to project light beams onto the side wall of the cylinder in a plurality of different positions as viewed in the longitudinal direction of the cylinder and are simultaneously turned on, and the ink remainder detecting means detects the remainder of ink in the ink container on the basis of the level of the electric signal output from the photodetector.

10. A printer as defined in claim 1 in which the light projecting means comprises a plurality of light emitting elements provided to project light beams onto the side wall of the cylinder in different circumferential positions in each longitudinal position.

* * * * *